US007597610B2

(12) United States Patent
Stoll

(10) Patent No.: US 7,597,610 B2
(45) Date of Patent: Oct. 6, 2009

(54) STAND-UP GRINDER CADDY WITH ADJUSTABLE HEIGHT AND LOW PROFILE FLOATING HEAD

(76) Inventor: David Stoll, 4040 Beckwood, San Antonio, TX (US) 78259

( * ) Notice: Subject to any disclaimer, the term of this patent is extended or adjusted under 35 U.S.C. 154(b) by 0 days.

(21) Appl. No.: 12/013,972

(22) Filed: Jan. 14, 2008

(65) Prior Publication Data

US 2008/0171499 A1 Jul. 17, 2008

Related U.S. Application Data

(60) Provisional application No. 60/880,876, filed on Jan. 16, 2007.

(51) Int. Cl.
*B24B 23/00* (2006.01)

(52) U.S. Cl. ..... 451/353; 451/350

(58) Field of Classification Search ..... 451/353, 451/350, 359

See application file for complete search history.

(56) References Cited

U.S. PATENT DOCUMENTS 2,507,052 A * 5/1950 Robinson ..... 451/353
2,603,919 A * 7/1952 Robinson ..... 451/353
4,845,798 A * 7/1989 Genovese ..... 15/98
6,786,556 B2 9/2004 Due
7,247,085 B1 * 7/2007 Anderson ..... 451/350
7,326,106 B1 * 2/2008 Rogers et al. ..... 451/350
7,435,160 B2 * 10/2008 Marrs, III ..... 451/11

* cited by examiner

*Primary Examiner*—Robert Rose

(57) ABSTRACT

An apparatus for a stand-up grinder caddy includes a handle assembly and an upper sheath. A lower caddy includes a wheel assembly and a lower sheath for insertion into the upper sheath. A bracket supports a grinder with the bracket attached to a support frame with a joint and to sides of the support frame with a floating head mechanism arranged so as not to extend above a top of the frame and thus minimize a height of the lower caddy for fitting under low overhanging obstacles. A head of the grinder contacts the floor surface and can follow contours of the floor surface. When a tilt handle is pressed the head can be tilted. A height adjustment mechanism adjusts a vertical position of the handle assembly for different user heights. The handle assembly can be rotated to a position such that the lower caddy can pass under overhanging obstacles.

20 Claims, 3 Drawing Sheets

STAND-UP GRINDER CADDY WITH ADJUSTABLE HEIGHT AND LOW PROFILE FLOATING HEAD

CROSS-REFERENCE TO RELATED APPLICATIONS

The present Utility patent application claims priority benefit of the U.S. provisional application for patent Ser. No. 60/880,876 filed on Jan. 16, 2007 under 35 U.S.C. 119(e). The contents of this related provisional application are incorporated herein by reference for all purposes.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to grinders. More particularly, the invention relates to the operation of a detachable handheld grinder mounted to a frame supported by wheels.

BACKGROUND OF THE INVENTION

There are many existing grinders that are used in the construction and floor coating industries. There are large grinders specifically designed to grind large areas. These large grinders enable operators to stand during operation. However, due to the configuration of the abrading discs, there is typically an area of the surface near walls or other obstacles that must remain un-ground by large grinders. Operators mainly use two methods for grinding areas that are unreachable with larger grinders. Operators may use handheld grinders that can grind up to the walls. However, these hand-held grinders are typically operated while on hands and knees, which results in operator fatigue and decreased productivity yet provides a significant amount of control. For example, a handheld grinder can be tilted when needed to grind sloped concrete around a drain or to grind out an occasional low spot found along a wall. Also with handheld grinders, an operator can use their body weight to apply pressure to the abrading disc.

A second method for grinding areas that are unreachable with larger grinders is to use a grinder carriage that is operated from behind and can be fitted with a small grinder that can be oriented to grind up against the wall. This method addresses some of the fatigue issue of handheld grinders; however, these grinder carriages typically cannot be adjusted for height. Also, it is not easy for the operator to adjust the angle of the grinder if the operator wishes to grind sloped concrete, for example, without limitation, around a drain or to grind out an occasional low spot found along a wall. Grinder carriages provide some methods for adjusting the angle of the abrading disc and the orientation of the grinding in relation to a wall, however, with these methods the operator must stop grinding to configure the grinder, which decreases productivity. Grinder carriages do not match the versatility one can obtain by using a handheld grinding apparatus due to the fact that the operator stands behind the grinder and has no means to adjust the angle of the grinder without stopping operation. In some instances the operator may need to provide added weight to the grinder to effectively grind areas, and with existing grinder carriages, it is difficult for operators to add weight to the grinding surface. Typically, the operator must add weights to the grinder carriage if possible. Furthermore, when an operator hits uneven concrete with an existing grinder carriage, the grinder is difficult to control unless the operator is standing or kneeling right next to the grinder. Also, currently known grinder caddies have high pivot points for the floating head. A high pivot point makes it difficult for an operator to reach under obstacles such as, but not limited to, cabinets, sinks, shelves, etc.

In view of the foregoing, there is a need for improved techniques for providing a grinder that may be used in tight areas such as, but not limited to, next to walls or under obstacles that reduces fatigue of the operator and provides a significant amount of control.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2 is a perspective view of the adjustable height mechanism, and FIG. 3 is a close-up perspective view of the adjustable height mechanism with the leg retracted and a leg release clamp disengaged.

Figure 1:
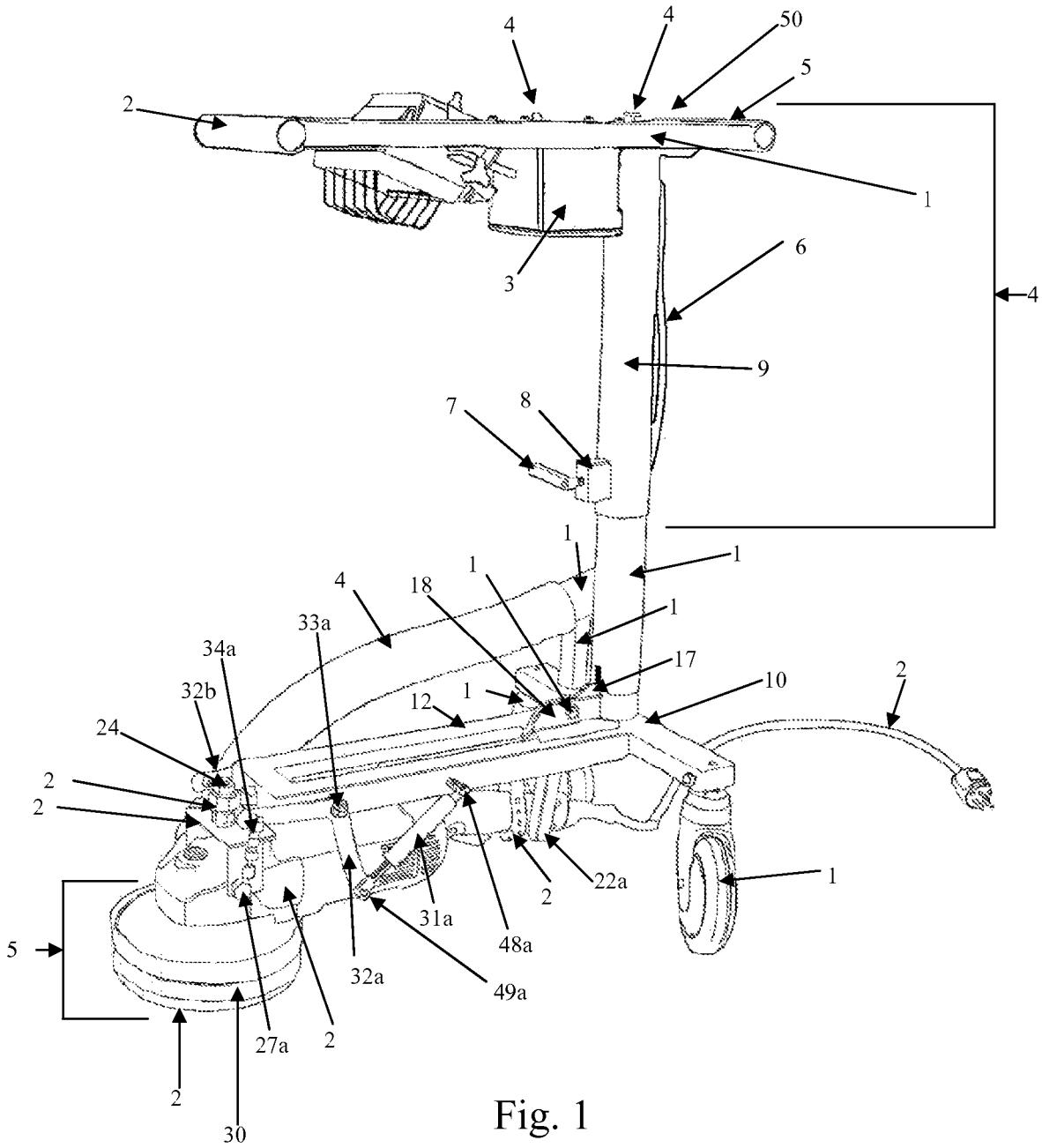
FIG. 1 is a perspective view of an exemplary stand-up grinder caddy with an adjustable height tilt mechanism and a low profile floating head, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a stand-up grinder caddy with adjustable height and low profile floating head is presented.

In one embodiment, a stand-up grinder caddy apparatus for a detachable grinder for a floor surface is presented. The apparatus includes an upper caddy including a handle assembly including a front handle and a back handle and an upper sheath positioned vertically downward and proximate the back handle. A lower caddy includes a wheel assembly and a lower sheath positioned vertically upward and proximate the wheel assembly. The lower sheath has a diameter suitable for insertion into the upper sheath. A support frame extends horizontally from the wheel assembly. A bracket supports a front portion of the grinder. The bracket is attached to a distal end of the support frame with a rod end joint and to sides of the support frame with a floating head mechanism such that a grinder head of the grinder contacts the floor surface and can follow contours of the floor surface. Left and right alignment posts are attached to the support bracket for positioning a handle of the grinder between the alignment posts. A tilt lever is attached to the support frame including a first end disposed in the lower sheath and a second end disposed in a opening of the support frame with a handle harness attached to the second end for vertically supporting the handle of the grinder. A height adjustment mechanism is attached to the upper sheath where when the height adjustment mechanism is disengaged a vertical position of the upper sheath relative to the lower sheath can be adjusted for different user heights and when the height adjustment mechanism is engaged the vertical position is maintained. The first handle is positioned in a first position on a vertical line passing through the grinder head such that the user can supply a downward pressure on the front handle to speed a grinding process of the floor surface. In another embodiment the apparatus further includes a tilt activating mechanism including a tilt handle attached to a tilt rod. The tilt handle is positioned proximate the handle assembly with the tilt rod extending through the upper and lower sheaths contacting the tilt lever where when the tilt handle is pressed the handle harness is vertically raised and the grinder head can be tilted. In yet another embodiment the tilt activating mechanism further includes an adjustable height mechanism where when the vertical position is adjusted a length of the tilt activating mechanism can be correspondingly adjusted. In still another embodiment when the height adjustment mechanism is disengaged the upper caddy can be rotated to a second position such that the lower caddy can pass under overhanging obstacles. In a further embodiment the floating head mechanism includes a plurality of floating head levers and springs arranged so as not to extend above a top of the support frame and thus minimize a height of the lower caddy for fitting under low overhanging obstacles. Yet another embodiment further includes a dust shroud configured to surround the grinding head and a vacuum port attached to the dust shroud where debris from the grinding process can be removed from the floor surface by a vacuum process. Other embodiments further include a light attached to the handle assembly for directing a beam of light to the floor surface to assist the user in the grinding process under overall dim lighting conditions and an electrical box attached to the upper caddy including and an on/off switch where the grinder can be plugged into the electrical box and the user can operate the power to the grinder with the switch.

In another embodiment, a stand-up grinder caddy apparatus for a detachable grinder for a floor surface is presented. The apparatus includes means for providing a handle assembly for moving the apparatus, means for providing a wheel assembly, means for supporting the grinder, means for allowing the grinder to follow contours of the floor surface and means for adjusting the height of the handle assembly means relative to the supporting means for different user heights. Other embodiments further include means for tilting the grinder, means for adjusting a height of the tilting means and means for rotating the handle assembly means such that the apparatus can pass under overhanging obstacles. Still other embodiments further include means for removing debris from a grinding process of the floor surface, means for lighting the floor surface and means for controlling a power to the grinder.

In another embodiment, a stand-up grinder caddy apparatus for a detachable grinder for a floor surface is presented. The apparatus includes an upper caddy including a handle assembly including a front handle and a back handle and an upper sheath positioned vertically downward and proximate the back handle. A lower caddy includes a wheel assembly and a lower sheath positioned vertically upward and proximate the wheel assembly. The lower sheath has a diameter suitable for insertion into the upper sheath. A support frame extends horizontally from the wheel assembly. A bracket supports a front portion of the grinder with the bracket attached to a distal end of the support frame with a rod end joint and to sides of the support frame with a floating head mechanism including a plurality of floating head levers and springs arranged so as not to extend above a top of the support frame and thus minimize a height of the lower caddy for fitting under low overhanging obstacles such that a grinder head of the grinder contacts the floor surface and can follow contours of the floor surface. Left and right alignment posts are attached to the support bracket for positioning a handle of the grinder between the alignment posts. A tilt lever attached to the support frame including a first end disposed in the lower sheath and a second end disposed in a opening of the support frame and a handle harness attached to the second end for vertically supporting the handle of the grinder. A tilt activating mechanism has a tilt handle attached to a tilt rod. The tilt handle is positioned proximate the handle assembly with the tilt rod extending through the upper and lower sheaths contacting the tilt lever where when the tilt handle is pressed the handle harness is vertically raised and the grinder head can be tilted. A height adjustment mechanism is attached to the upper sheath where when the height adjustment mechanism is disengaged a vertical position of the upper sheath relative to the lower sheath can be adjusted for different user heights. When the height adjustment mechanism is engaged the vertical position is maintained and the first handle is positioned in a first position on a vertical line passing through the grinder head such that the user can supply a downward pressure on the front handle to speed a grinding process of the floor surface. When the height adjustment mechanism is disengaged the upper caddy can be rotated to a second position such that the lower caddy can pass under overhanging obstacles. In another embodiment the tilt activating mechanism further includes an adjustable height mechanism where when the vertical position is adjusted a length of the tilt activating mechanism can be correspondingly adjusted. Yet another embodiment further includes a dust shroud configured to surround the grinding head and a vacuum port attached to the dust shroud where debris from the grinding process can be removed from the floor surface by a vacuum process. Still other embodiment further include a light attached to the handle assembly for directing a beam of light to the floor surface to assist the user in the grinding process under overall dim lighting conditions and an electrical box attached to the upper caddy including and an on/off switch where the grinder can be plugged into the electrical box and the user can operate the power to the grinder with the switch.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Embodiments of the present invention provide grinder caddies that can be mounted with hand-held grinders that may be used to grind concrete or other suitable surfaces while operators are in standing positions and have significant control over the maneuverability of the grinders. The preferred embodiment of the present invention is a grinding apparatus that has an adjustable height that can match the height of the operator. The preferred embodiment also has a low profile floating head that enables a user to effectively grind under areas that are typically unreachable by currently known standing grinders, for example, without limitation, near walls, under sinks, under cabinets or shelves, etc.

In the past, grinder caddies have not had the ability to be adjusted for height and have had a high pivot point for the floating head. Also, due to the previous design, areas that grinders could reach were limited. Embodiments of the present invention have several advantages over current grinders. For example, without limitation, the ability to adjust the height of the grinder caddy to match height of operator may increase productivity due to an increase in ease of use. Also, lowering the pivot point of the floating head enables the user to be able to reach under cabinets and other obstructions that cannot be reached by current stand up grinders. In some embodiments an upper handle of the grinder caddy rotates to increase the ability of the grinder to reach under obstacles, such as, but not limited to, shelves, cabinets, sinks, etc. Furthermore, some embodiments comprise a flat surface above the grinder upon which an operator may place a foot to apply pressure to the grinder. This takes the strain off of the hands when applying pressure and results in greater productivity.

FIG. 1 is a perspective view of an exemplary stand-up grinder caddy with an adjustable height tilt mechanism and a low profile floating head, in accordance with an embodiment of the present invention. In the present embodiment an upper caddy handle 1 comprises a front handle 2, an electrical box 3, an on/off switch 4, a back handle 5, and a light 53. A power cord 6 runs from electrical box 3 to a standard power outlet (not shown). Light 53 may be turned on to improve visibility when grinding in poorly lit areas. Alternate embodiments may not comprise a light. In the present embodiment, a height adjustment bolt 7 is screwed into a height adjustment clamp housing 8. A tongue (not shown) is cut out of an upper caddy sheath 9 where height adjustment bolt 7 applies pressure to hold an upper caddy 46 at a specific height. In alternate embodiments, various other means may be used to hold the upper caddy at the desired height such as, but not limited to, a clamp, a threaded leg, a bolt with cut holes, etc. Upper caddy sheath 9 fits snuggly around a lower caddy sheath 11. A leg release lever 40 controls an adjustable height mechanism within upper caddy sheath 9 and lower caddy sheath 11, shown by way of example in FIGS. 2 and 3. Also a grinder tilt handle 50 enables the operator to adjust the tilt of a grinder 26 mounted to the grinder caddy.

A lower caddy 10 comprises a lower caddy u-support 12 and left and right castor wheels, 13 and 14 respectively. Castor wheels 13 and 14 enable the grinder caddy to be easily maneuvered by an operator. A vacuum pipe support 15 is welded to lower caddy 10. Attached to vacuum pipe support 15 is a vacuum pipe 16. Within lower caddy u-support 12 is a tilt lever support 18. Tilt lever support 18 holds a tilt lever 17 via a tilt lever pivot bolt 19. A grinder handle harness 21 is attached to tilt lever 17 via a bolt (not shown). Attached to the bottom of lower caddy u-support 12 are a left grinder alignment post 22*a* and a right grinder alignment post (not shown). A rod end joint 23 is bolted to lower caddy u-support 12. A grinder bracket 25 is attached to rod end joint 23 via a grinder bracket bolt 24. Grinder bracket 25 holds grinder 26 via a left grinder bolt 27*a* and a right grinder bolt (not shown) so that a grinder head 52 rests on the surface to be ground.

A grinder power cord 28 is plugged into electrical box 3 during operation of grinder 26. A dust shroud 29 is held in place via a shroud seal clamp 30. A vacuum hose 47 runs from dust shroud 29 to vacuum pipe 16. Vacuum hose 47 and vacuum pipe 16 direct the dust captured in dust shroud 29 in a direction away from the operator, and some embodiments may also include a bag to collect this dust at the opening of vacuum pipe 16. Alternate embodiments may be implemented without a dust shroud, vacuum hose or vacuum pipe. In the present embodiment, a left gas spring 31*a* and a right gas spring (not shown) are attached to lower caddy u-support 12 via a left bolt 48*a* and a right bolt. A left floating head lever 32*a* and a right floating head lever 32*b* are attached to left gas spring 31*a* and right gas spring by a left bolt 49*a* and a right bolt (not shown). Left floating head lever 32*a* and right floating head lever 32*b* are attached to lower caddy u-support 12 via a left floating head bolt 33*a* and a right floating head bolt (not shown). Left floating head lever 32*a* and right floating head lever 32*b* are attached to grinder bracket 25 via a left swivel joint rod end linkage 34*a* and a right swivel joint rod end linkage (not shown).

In typical use of the present embodiment, an operator stands alongside grinder 26 and can adjust the height of upper caddy handle 1 by loosening height adjustment bolt 7 and sliding upper caddy sheath 9 to a comfortable height, then tightening height adjustment bolt 7 to lock upper caddy 46 into place. If an operator needs to grind under obstacles, such as, but not limited to, cabinets or sinks, the operator can loosen height adjustment bolt 7 and rotate the entire upper caddy 46 over 90 degrees for maximum clearance. Also, grinder 26 is mounted in such a way to lower caddy u-support 12 that the area under which the grinder can reach is maximized. In order to speed grinding time, an operator can apply weight to the grinder. This is easy to accomplish with the present embodiment by pressing down on front handle 2. If additional weight is needed, an operator may place a foot directly above grinder 26 on lower caddy u-support 12. Alternate embodiments may comprise a plate attached to lower caddy u-support 12 to provide a larger area for the operator to apply pressure to grinder 26 with his foot. In the present embodiment, grinder head 52 is able to glide over uneven surfaces and grind the top off this uneven surface due to the floating head mechanism. The floating head mechanism works due to rod end joint 23 and gas springs 31*a* and 31*b*, which enable grinder head 52 to move up and down freely. Alternately, one may use levers and pulleys to mount the grinder to the u-support 12. The low mounted configuration of gas springs 31*a* and 31*b* as they are attached to grinder bracket 25 and lower caddy u-support 12 in the present embodiment and the low pivot point of this system enable grinder head 52 to follow the contours of uneven concrete and fit under obstacles more effectively than previously known designs.

Figure 2:
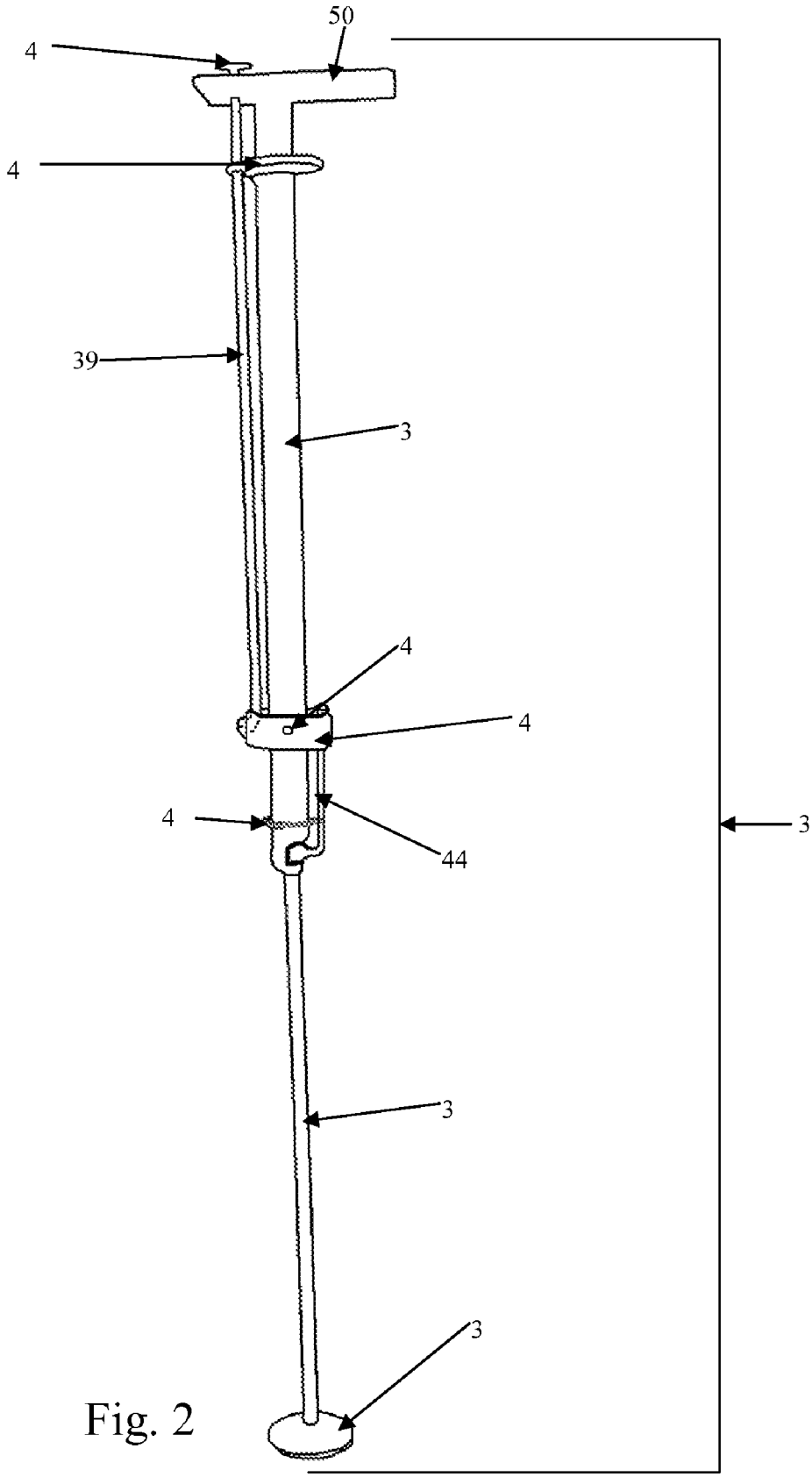
FIGS. 2 and 3 illustrate an exemplary adjustable height mechanism from a stand-up grinder caddy with adjustable height, in accordance with an embodiment of the present invention.
Figure 3:
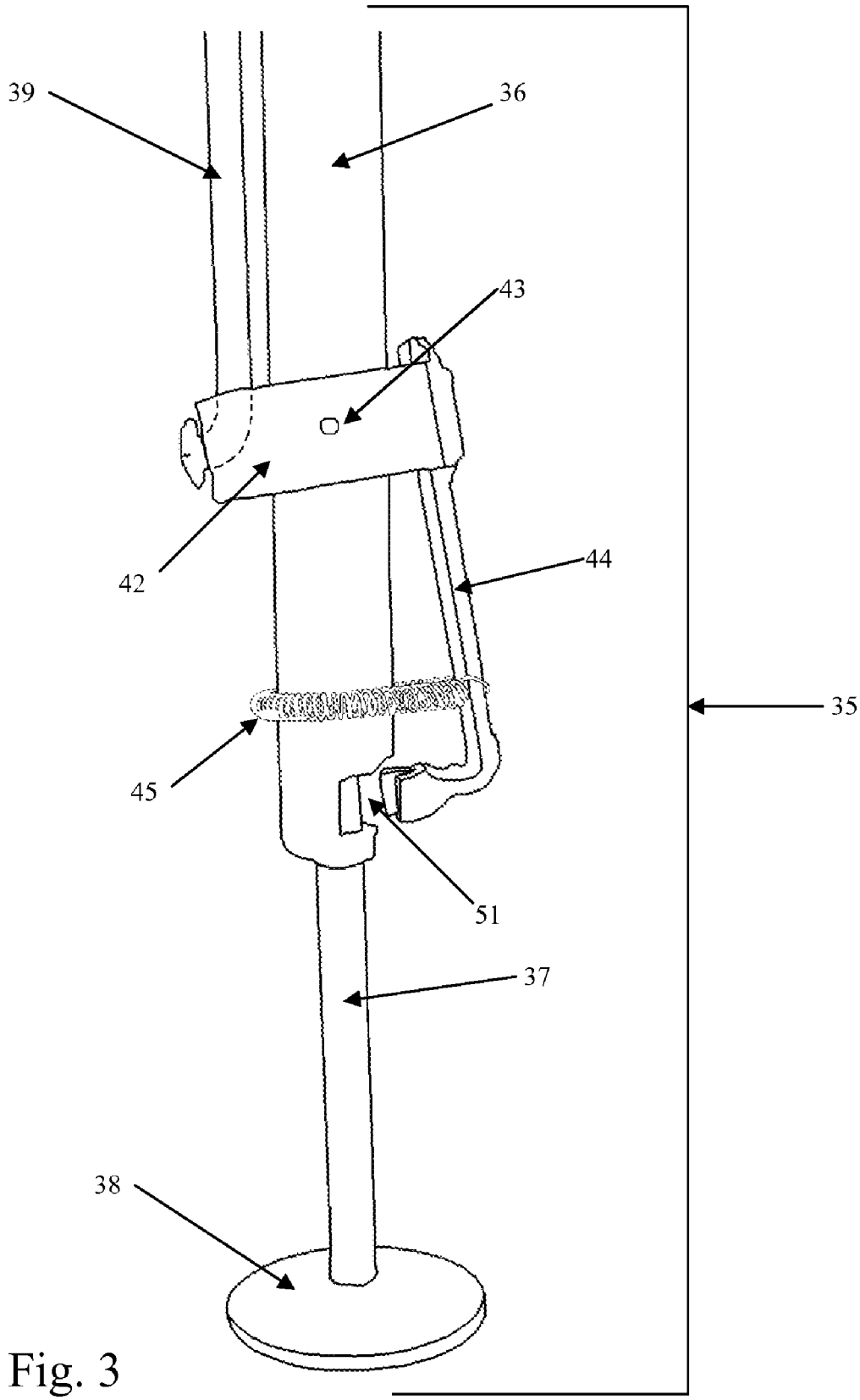

FIGS. 2 and 3 illustrate an exemplary adjustable height mechanism 35 from a stand-up grinder caddy with adjustable height, in accordance with an embodiment of the present invention. FIG. 2 is a perspective view of adjustable height mechanism 35, and FIG. 3 is a close-up perspective view of adjustable height mechanism 35 with a leg 37 retracted and a leg release clamp 44 disengaged. In the present embodiment, a leg sheath 36 comprises a leg release rod 39, a leg release lever 40, and a spacing ring 41, which holds leg release rod 39. Leg release lever 40 is located above a grinder tilt handle 50 on leg release rod 39. Leg release rod 39 is fed through a leg release pivot 42, which is attached to leg sheath 36 via a leg release pivot bolt 43. Leg release clamp 44 is welded to leg release pivot 42. In alternate embodiments leg release pivot 42 and leg release clamp 44 may be attached with various different means such as, but not limited to, a bolt, etc. In the present embodiment, leg release clamp 44 fits into a leg sheath cutout 51 when leg release point 40 is not pressed holding leg 37 in place. Leg release clamp 44 is held against leg sheath cutout 51 via a spring 45. In alternate embodiments leg release clamp 44 may hold leg 37 in place using alternate means such as, but not limited to, notches in leg 37 into which leg release clamp 44 fits, leg 37 may be threaded and adjusted by rotating the leg 37 inside leg sheath 36, etc. [It should be further mentioned that in the preferred embodiment leg 37 is threaded and the leg release clamp 44 has a threaded nut that prevents the leg from slipping. In the present embodiment, leg 37 is partly sheathed in leg sheath 36. A leg base 38 is attached to the bottom of leg 37. Adjustable height mechanism 35 is encased in upper caddy sheath 9 and lower caddy sheath 11, shown by way of example in FIG. 1. Leg base 38 rests on top of tilt lever 17 inside of lower sheath 11, shown by way of example in FIG. 1. In the present embodiment, grinder tilt handle 50 and leg release point 40 extend above back handle 5, shown by way of example in FIG. 1.

The length of adjustable height mechanism 35 can be adjusted by pressing on leg release point 40 to loosen leg release clamp 44 to compensate for the height of upper caddy 46 when raised or to increase the angle that grinder head 52 can be tilted. To lengthen or shorten adjustable height mechanism 35, the operator pushes down on leg release point 40, which raises leg release clamp 44 from leg sheath cutout 51 allowing leg 37 to extend or retract. When leg 37 is extended or retracted to an adequate length for grinder tilt handle 50 to raise above back handle 5 pressure applied to leg release point 40 is released, which causes leg release clamp 44 to lock leg 37 into place. The operator is then able to change the angle of grinder 26 while operating grinder 26 by pressing down on grinder tilt handle 50, which causes leg base 38 to apply pressure to tilt lever 17.

In order to effectively grind along walls or on sloped concrete, for example, without limitation, around drains, the operator may control the angle of grinder 26. In typical use of the present invention, grinder 26 is mounted to lower caddy u-support 12 so that grinder head 52 is flat when grinder tilt handle is in a neutral position. To change the angle of grinder head 52, an operator presses down on grinder tilt handle 50 and leg base 38 of adjustable height mechanism 35 pushes down on tilt lever 17. When tilt lever 17 is depressed, grinder handle harness 21 rises, raising the back of grinder 26 and tilting the front end of grinder 26 including grinder head 52 in a downward direction. Grinder head 52 pivots around left grinder bolt 27*a* and right grinder bolt attaching grinder head 52 to grinder bracket 25. Left grinder alignment post 22*a* and right grinder alignment post 22*b* keep grinder 26 lined up with lower caddy u-support 12 by restricting the movement of grinder 26 in the left and right directions. In the present embodiment, the operator maintains pressure on grinder tilt handle 50 to maintain the desired angle for grinder 26. However, alternate embodiments may comprise means for holding the grinder at a desired angle such as, but not limited to a strap to hold down the grinder tilt handle, a clamp, preset angle settings corresponding to catch points on the leg sheath, etc.

In alternate embodiments leg 37 may not include a leg base, and instead leg 37 may be directly attached to tilt lever 17 for example, without limitation, with a pivot bolt. In these embodiments the operator may tilt grinder head 52 downward or upward by either pushing or pulling on grinder tilt handle 50. Pulling on grinder tilt handle 50 pulls tilt lever 17 up thus lowering handle harness 21 and the back of grinder 26, and this tilts grinder head 52 upward. In other alternate embodiments the angle of the grinder may be controlled with various different means. For example, without limitation, a foot pedal may be attached to the tilt lever enabling the operator to control the angle of the grinder with his foot, or a hand lever may be attached to the tilt lever. Some of these alternate embodiments may not comprise a height adjusting mechanism for the grinder tilt control if the control means are implemented on the lower caddy rather than the upper caddy since the lower caddy does not move when the height of the upper caddy is adjusted.

Those skilled in the art, in light of the present teachings, will recognize that alternate embodiments of the present invention may comprise different materials, sizes, and interconnections for all components. For example, without limitation, various means other than height adjustment bolt 7 may be used to hold the upper caddy at the desired height such as, but not limited to, a clamp, a threaded leg, a bolt with cut holes, etc. Also, the grinder handle may be mounted to the caddy by various means other than grinder handle harness 21 such as, but not limited to, a hook, an adjustable strap, etc., and these means may be attached to tilt handle 17 with various means, such as, but not limited to, bolts, welding, buckles, clamps, etc. Furthermore, the grinder tilt handle may be shaped differently or the upper caddy handle may be shaped differently or may comprise various different grips. For example, without limitation, in an alternate embodiment, the upper caddy handle may comprise a U-shaped handle with grips similar to a bicycle handle. Furthermore, the electrical box may not be included in some alternate embodiments. In embodiments not comprising an electrical box, the power cord of the grinder mounted in the caddy is plugged directly into a standard wall socket.

Having fully described at least one embodiment of the present invention, other equivalent or alternative methods of providing a standup grinder caddy with adjustable height according to the present invention will be apparent to those skilled in the art. The invention has been described above by way of illustration, and the specific embodiments disclosed are not intended to limit the invention to the particular forms disclosed. For example, the particular implementation of the grinder mounting means may vary depending upon the particular type of grinder used. The grinder mounting means described in the foregoing were directed to implementations using small hand held grinders; however, similar techniques are to use larger grinders or a built in grinder head. Implementations of the present invention using various different grinders are contemplated as within the scope of the present invention. The invention is thus to cover all modifications, equivalents, and alternatives falling within the spirit and scope of the following claims.

What is claimed is:

1. A stand-up grinder caddy apparatus for a detachable grinder for a floor surface, the apparatus comprising:

an upper caddy comprising a handle assembly comprising a front handle and a back handle and an upper sheath positioned vertically downward and proximate said back handle;

a lower caddy comprising a wheel assembly, a lower sheath positioned vertically upward and proximate said wheel assembly, said lower sheath comprising a diameter suitable for insertion into said upper sheath, a support frame extending horizontally from said wheel assembly, a bracket for supporting a front portion of the grinder, said bracket attached to a distal end of said support frame with a rod end joint and to sides of said support frame with a floating head mechanism such that a grinder head of the grinder contacts the floor surface and can follow contours of the floor surface, left and right alignment posts attached to said support bracket for positioning a handle of the grinder between said alignment posts, a tilt lever attached to said support frame comprising a first end disposed in said lower sheath and a second end disposed in a opening of said support frame and a handle harness attached to said second end for vertically supporting the handle of the grinder; and a height adjustment mechanism attached to said upper sheath where when said height adjustment mechanism is disengaged a vertical position of said upper sheath relative to said lower sheath can be adjusted for different user heights and when said height adjustment mechanism is engaged said vertical position is maintained and said first handle is positioned in a first position on a vertical line passing through the grinder head such that said user can supply a downward pressure on said front handle to speed a grinding process of the floor surface.

2. The apparatus as recited in claim 1, further comprising a tilt activating mechanism comprising a tilt handle attached to a tilt rod, said tilt handle positioned proximate said handle assembly with said tilt rod extending through said upper and lower sheaths contacting said tilt lever where when said tilt handle is pressed said handle harness is vertically raised and the grinder head can be tilted.

3. The apparatus as recited in claim 2, wherein said tilt activating mechanism further comprises an adjustable height mechanism where when said vertical position is adjusted a length of said tilt activating mechanism can be correspondingly adjusted.

4. The apparatus as recited in claim 3, wherein when said height adjustment mechanism is disengaged said upper caddy can be rotated to a second position such that said lower caddy can pass under overhanging obstacles.

5. The apparatus as recited in claim 1, wherein said floating head mechanism comprises a plurality of floating head levers and springs arranged so as not to extend above a top of said support frame and thus minimize a height of said lower caddy for fitting under low overhanging obstacles.

6. The apparatus as recited in claim 1, further comprising a dust shroud configured to surround the grinding head and a vacuum port attached to said dust shroud where debris from said grinding process can be removed from the floor surface by a vacuum process.

7. The apparatus as recited in claim 1, further comprising a light attached to said handle assembly for directing a beam of light to the floor surface to assist said user in said grinding process under overall dim lighting conditions.

8. The apparatus as recited in claim 1, further comprising an electrical box attached to said upper caddy comprising and an on/off switch where the grinder can be plugged into said electrical box and said user can operate the power to the grinder with said switch.

9. A stand-up grinder caddy apparatus for a detachable grinder for a floor surface, the apparatus comprising:

means for moving the apparatus, with a front handle, a back handle and an upper sheath;

means for rolling the apparatus, with a wheel assembly, a support frame and a lower sheath inserted into said upper sheath;

means for supporting the grinder below said support frame;

means for allowing the grinder to move relative to said support frame to follow contours of the floor surface; and means for adjusting a height of said moving means relative to said support frame by adjusting an amount of insertion of said lower sheath into said upper sheath.

10. The apparatus as recited in claim 9, further comprising means for tilting the grinder relative to said support frame by operating a tilt handle located in proximity to said back handle.

11. The apparatus as recited in claim 10, further comprising means for adjusting a height of said tilting means in conjunction with adjusting said amount of insertion.

12. The apparatus as recited in claim 11, further comprising means for rotating said moving means in a plane parallel to said support frame.

13. The apparatus as recited in claim 9, further comprising means for removing debris from a grinding process of the floor surface.

14. The apparatus as recited in claim 9, further comprising means for lighting the floor surface.

15. The apparatus as recited in claim 9, further comprising means for controlling a power to the grinder.

16. A stand-up grinder caddy apparatus for a detachable grinder for a floor surface, the apparatus comprising:

an upper caddy comprising a handle assembly comprising a front handle and a back handle and an upper sheath positioned vertically downward and proximate said back handle;

a lower caddy comprising a wheel assembly, a lower sheath positioned vertically upward and proximate said wheel assembly, said lower sheath comprising a diameter suitable for insertion into said upper sheath, a support frame extending horizontally from said wheel assembly, a bracket for supporting a front portion of the grinder, said bracket attached to a distal end of said support frame with a rod end joint and to sides of said support frame with a floating head mechanism comprising a plurality of floating head levers and springs arranged so as not to extend above a top of said support frame and thus minimize a height of said lower caddy for fitting under low overhanging obstacles such that a grinder head of the grinder contacts the floor surface and can follow contours of the floor surface, left and right alignment posts attached to said support bracket for positioning a handle of the grinder between said alignment posts, a tilt lever attached to said support frame comprising a first end disposed in said lower sheath and a second end disposed in a opening of said support frame and a handle harness attached to said second end for vertically supporting the handle of the grinder;

a tilt activating mechanism comprising a tilt handle attached to a tilt rod, said tilt handle positioned proximate said handle assembly with said tilt rod extending through said upper and lower sheaths contacting said tilt lever where when said tilt handle is pressed said handle harness is vertically raised and the grinder head can be tilted; and a height adjustment mechanism attached to said upper sheath where when said height adjustment mechanism is disengaged a vertical position of said upper sheath relative to said lower sheath can be adjusted for different user heights and when said height adjustment mechanism is engaged said vertical position is maintained and said first handle is positioned in a first position on a vertical line passing through the grinder head such that said user can supply a downward pressure on said front handle to speed a grinding process of the floor surface and when said height adjustment mechanism is disengaged said upper caddy can be rotated to a second position such that said lower caddy can pass under overhanging obstacles.

17. The apparatus as recited in claim 16, wherein said tilt activating mechanism further comprises an adjustable height mechanism where when said vertical position is adjusted a length of said tilt activating mechanism can be correspondingly adjusted.

18. The apparatus as recited in claim 16, further comprising a dust shroud configured to surround the grinding head and a vacuum port attached to said dust shroud where debris from said grinding process can be removed from the floor surface by a vacuum process.

19. The apparatus as recited in claim 16, further comprising a light attached to said handle assembly for directing a beam of light to the floor surface to assist said user in said grinding process under overall dim lighting conditions.

20. The apparatus as recited in claim 16, further comprising an electrical box attached to said upper caddy comprising and an on/off switch where the grinder can be plugged into said electrical box and said user can operate the power to the grinder with said switch.

* * * * *